US010847938B2

(12) United States Patent
So et al.

(10) Patent No.: US 10,847,938 B2
(45) Date of Patent: Nov. 24, 2020

(54) ANTENNA CABLE CONNECTING MODULE AND METHOD FOR PRODUCING ANTENNA CABLE CONNECTING MODULE

(71) Applicant: KMW INC., Hwaseong-si (KR)

(72) Inventors: Sunghwan So, Hwaseong-si (KR); Seongman Kang, Hwaseong-si (KR); Eunsuk Jung, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 17 days.

(21) Appl. No.: 16/186,667

(22) Filed: Nov. 12, 2018

(65) Prior Publication Data

US 2019/0081443 A1 Mar. 14, 2019

Related U.S. Application Data

(63) Continuation of application No. PCT/KR2017/004549, filed on Apr. 28, 2017.

(30) Foreign Application Priority Data

May 12, 2016 (KR) ..... 10-2016-0058175

(51) Int. Cl.
*H01R 24/38* (2011.01)
*H01Q 1/24* (2006.01)
(Continued)

(52) U.S. Cl.
CPC ..... *H01R 24/38* (2013.01); *H01Q 1/24* (2013.01); *H01Q 1/50* (2013.01); *H01R 13/655* (2013.01);
(Continued)

(58) Field of Classification Search
CPC .... H01R 24/38; H01R 24/52; H01R 2201/02; H01R 9/0527
See application file for complete search history.

(56) References Cited

U.S. PATENT DOCUMENTS 6,007,378 A * 12/1999 Oeth ..... H01R 13/5213 439/279
6,164,997 A * 12/2000 Davies ..... H01R 13/5025 439/274
(Continued)

FOREIGN PATENT DOCUMENTS

JP H05-81955 U 11/1993
JP 07-254459 A 10/1995
(Continued)

OTHER PUBLICATIONS

International Search Report for PCT/KR2017/004549 dated Jul. 28, 2017 and its English translation.

*Primary Examiner* — Tho D Ta

(57) ABSTRACT

An antenna cable connection module in accordance with the present disclosure includes an antenna cable for forming a contact point connected to an antenna filter part; a body part located on the outer circumferential surface of the antenna cable, and inserted into a receiving port located on the antenna filter part together with the end portion of the antenna cable and coupled to the antenna filter part; and a bush interposed between the antenna cable and the body part, and having an inclined surface having a slope in a longitudinal direction formed thereon to strengthen the coupling between the antenna filter part and the antenna cable. As a result, it is possible to constitute a simple antenna cable connection module of a ground contact type, thus providing a device reducing the failure occurrence rate. In addition, it is possible to constitute a simple antenna cable connection module for an operator to easily operate, thus reducing the labor cost and saving the time consumed for an antenna cable connection.

13 Claims, 7 Drawing Sheets

(51) Int. Cl.

| | |
|---|---|
| ***H01Q 1/50*** | (2006.01) |
| ***H01R 13/655*** | (2006.01) |
| ***H01R 43/20*** | (2006.01) |
| *H01R 24/52* | (2011.01) |
| *H01R 9/05* | (2006.01) |
| *H01R 103/00* | (2006.01) |

(52) U.S. Cl.
CPC ..... *H01R 43/20* (2013.01); *H01R 9/0527* (2013.01); *H01R 24/52* (2013.01); *H01R 2103/00* (2013.01); *H01R 2201/02* (2013.01)

(56) References Cited

U.S. PATENT DOCUMENTS

| | | | | |
|---|---|---|---|---|
| 6,238,218 | B1 | 5/2001 | Baffert | |
| 6,741,142 | B1 | 5/2004 | Okazaki et al. | |
| 8,905,783 | B2 * | 12/2014 | Umemoto ..... | H01R 33/965 439/587 |
| 9,385,446 | B2 * | 7/2016 | Palinkas ..... | H01R 9/0527 |
| 9,653,823 | B2 * | 5/2017 | Eriksen ..... | H01R 9/0524 |
| 2016/0049739 | A1 | 2/2016 | Watkins | |

FOREIGN PATENT DOCUMENTS

| | | | |
|---|---|---|---|
| JP | 2000-138086 | A | 5/2000 |
| JP | 2005-117628 | A | 4/2005 |
| KR | 10-2006-0049141 | A | 5/2006 |
| KR | 10-1300430 | B1 | 8/2013 |
| KR | 10-2013-0141152 | A | 12/2013 |

* cited by examiner

[FIG. 3]
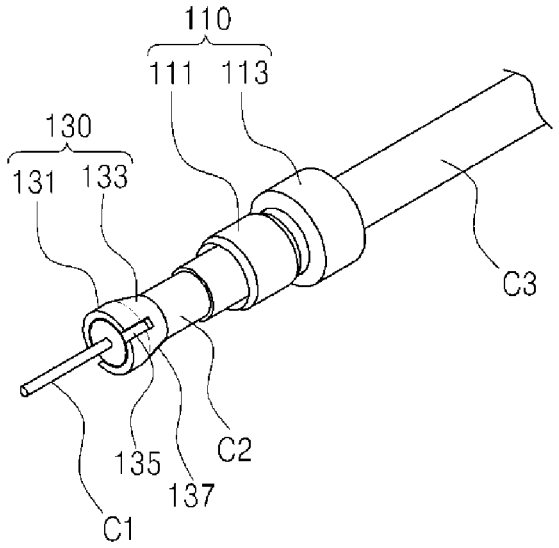
[FIG. 4]
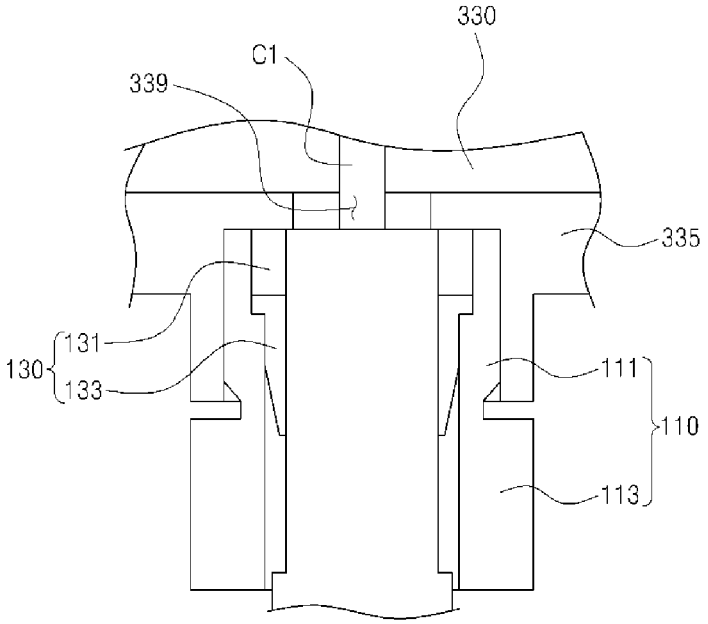

[FIG. 5]
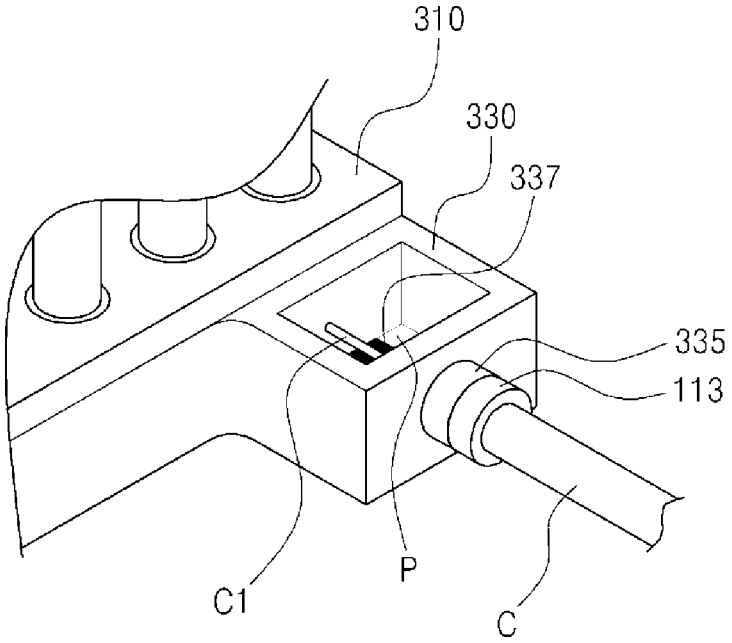

[FIG. 6]
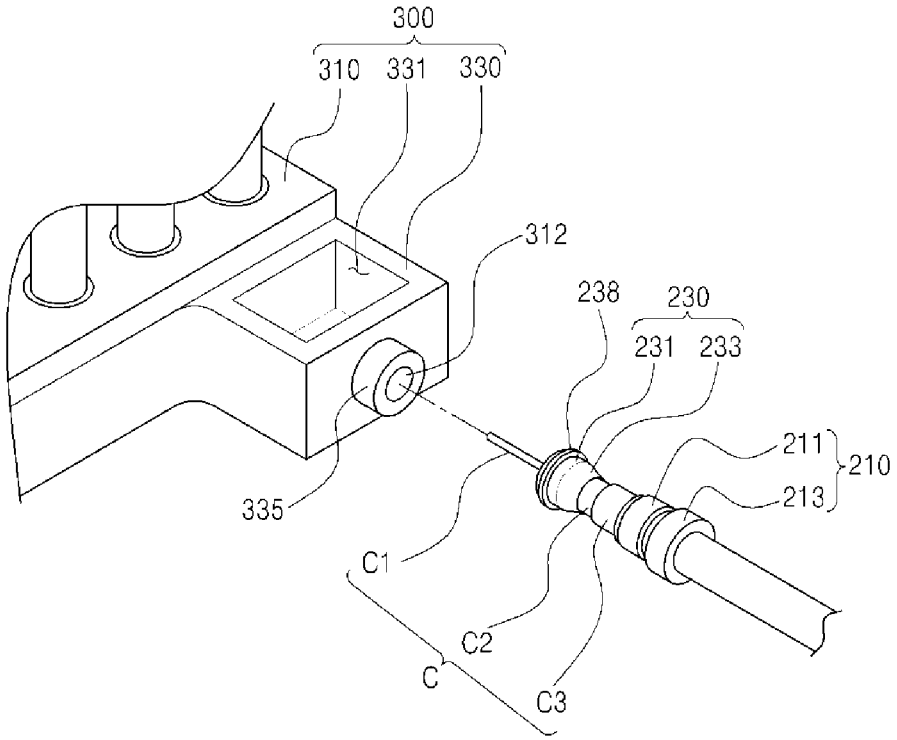

[FIG. 7]
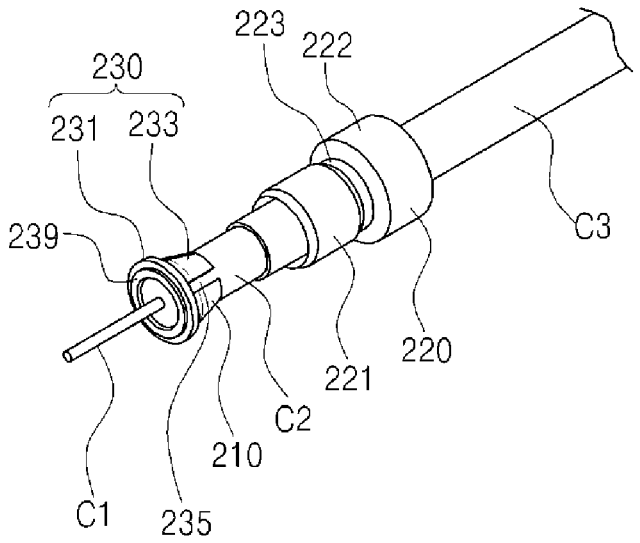
[FIG. 8]
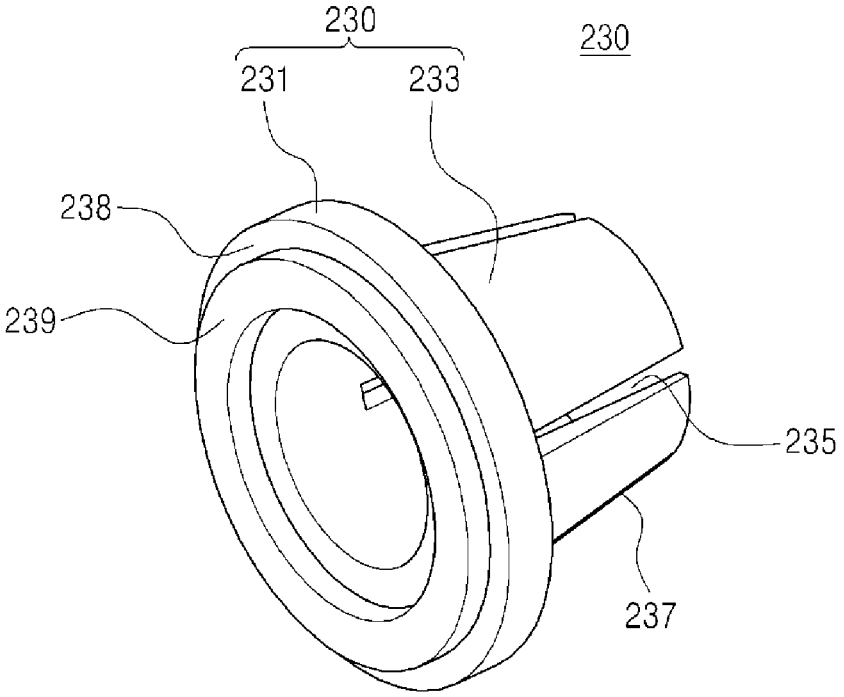

[FIG. 9]
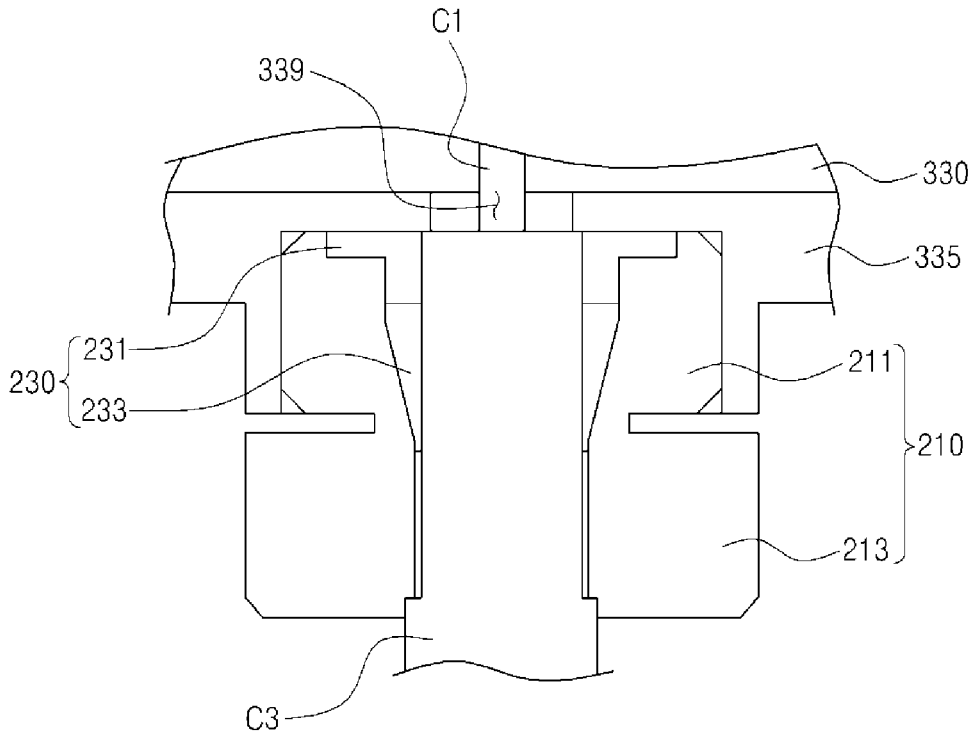
[FIG. 10]
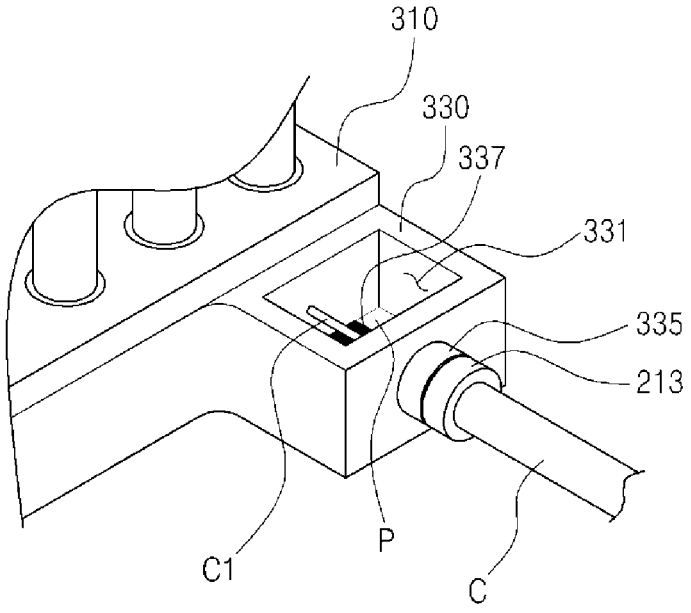

[FIG. 11]
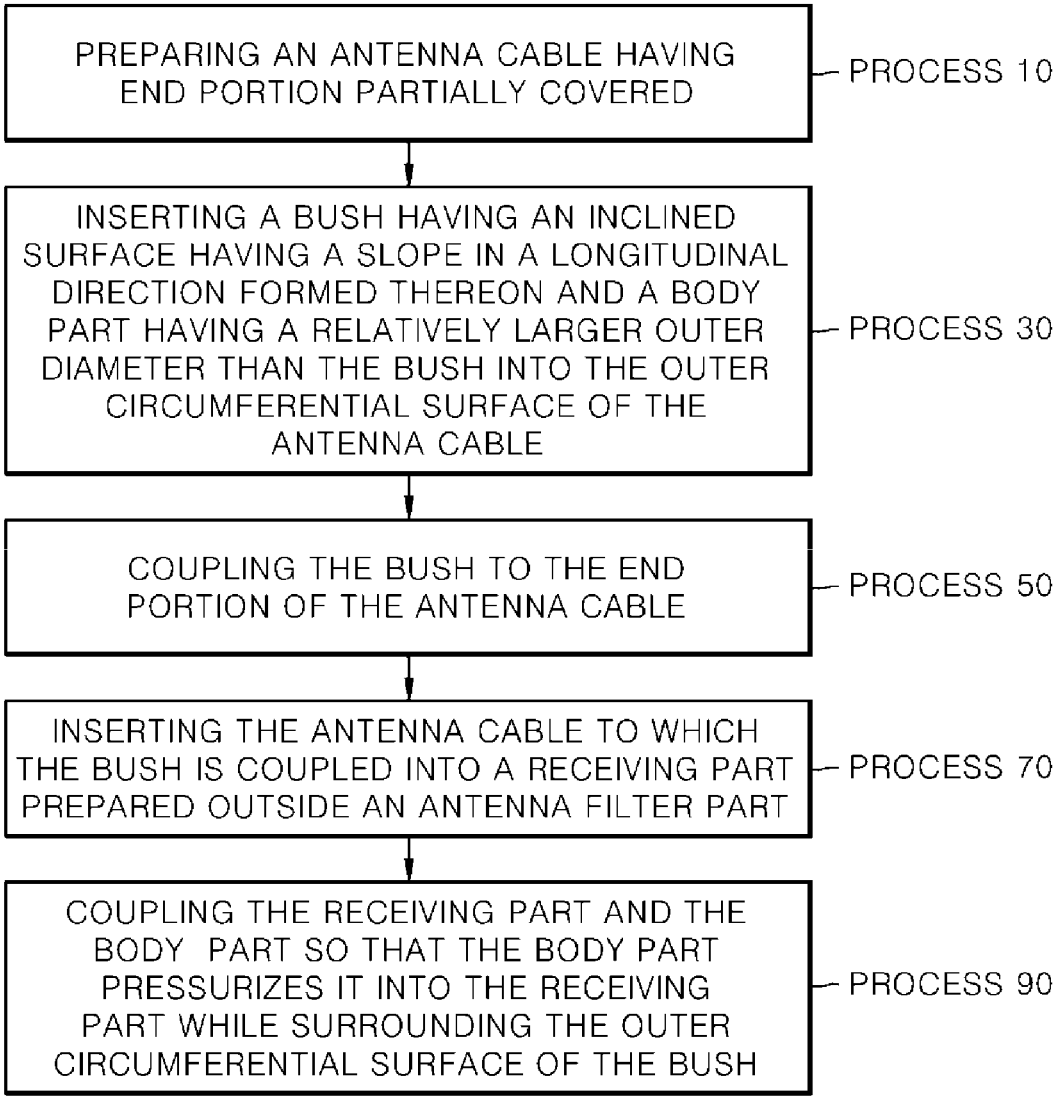

ANTENNA CABLE CONNECTING MODULE AND METHOD FOR PRODUCING ANTENNA CABLE CONNECTING MODULE

CROSS-REFERENCE TO RELATED APPLICATIONS

This application is a Continuation of International Application No. PCT/KR2017/004549, filed on Apr. 28, 2017, which claims the benefit of and priority to Korean Patent Application No. 10-2016-0058175, filed on May 12, 2016, the content of which are herein incorporated by reference in their entirety.

TECHNICAL FIELD

The present disclosure relates to an antenna cable connection module and a method for manufacturing the same, which can easily connect a cable without solder.

BACKGROUND ART

Generally, a composite antenna cable for transmitting/receiving a specific signal such as a high frequency radio signal is connected to an equipment or parts such as a switching station device, a base station device, or a repeater. As the number of antennas located in the base station, etc. increases according to a recent communication method, the number of Remote Radio Heads (RRH) or the number of connected equipments thereby is also increasing.

In addition, in recent years, an antenna widely used in the base station or the repeater of a mobile communication system has various functions due to advanced communication environments, and market demands are also diversified.

A large number of RF cables are used in such an antenna, and are connected to various devices in order to implement the RF characteristics of such RF cables. In order to connect these cables and the devices, most of the existing modules are connected by solder to an antenna filter and the cable.

However, there has been a problem in that the antenna connection method by the solder is manually performed by a skilled operator for a long period of time, such that it is difficult for an ordinary operator to perform the process, and a failure occurrence rate due to the characteristics of the solder process is high.

In addition, there has been also a problem in that the labor cost required for a skilled operator increases and the time required for the solder process increases when working through the existing method.

FIG. 1 is a perspective diagram illustrating a flange cable assembly according to the related art. As illustrated in FIG. 1, in the connection of the antenna filter and the cable, an antenna module has been coupling an antenna cable C to a connection connector 2 located to be protruded from a flange 1 by soldering.

In the flange cable assembly implemented by the manufacturing method, the connection connector 2, which is a portion to which the antenna cable is connected, is located to be protruded to the outside, such that damages such as scratch caused by other devices can occur, resulting in failure of the module itself.

In addition, there has been a problem in that the conventional flange cable assembly requires soldering for most of the end portions of the antenna cable C connected to the connection connector 2 of the flange 1 and the soldering is performed manually by the operator, such that it is highly dependent upon the skill level of the operator, resulting in a large number of the defective rate of the product.

In addition, there has been a problem in that when lead for soldering is used in a large amount for each connection structure due to the characteristics of the antenna equipment, the weight of the entire antenna equipment can be increased, and in most cases, parts cost required for fixing the antenna equipment due to the characteristics of the product installed at a high location additionally occurs, such that the manufacturing cost and time are greatly increased.

DISCLOSURE

Technical Problem

The present disclosure provides a simple antenna cable connection module of a ground contact type, thus implementing a device with a reduced failure occurrence rate.

The present disclosure provides a simple antenna cable connection module so that ordinary operators can easily operate, thus implementing a device that can reduce the labor cost and save the time.

The present disclosure can connect the antenna cable with only minimal solder, thus implementing a device that can save the parts cost and reduce the weight of the product.

Technical Solution

An antenna cable connection module in accordance with various embodiments of the present disclosure can include an antenna cable for forming a contact point connected to an antenna filter part; a body part located on the outer circumferential surface of the antenna cable, and inserted into a receiving port located on the antenna filter part together with the end portion of the antenna cable and coupled to the antenna filter part; and a bush interposed between the antenna cable and the body part, and having an inclined surface having a slope in a longitudinal direction formed thereon to strengthen the coupling between the antenna filter part and the antenna cable.

According to an embodiment of the present disclosure, the antenna filter part can include an antenna receiving part for receiving a core wire of the antenna cable, and the antenna receiving part can include a contact member that is located at the lower side of a receiving space of the antenna receiving part, and for forming a contact point with the core wire of the antenna cable having passed through the receiving port.

According to an embodiment of the present disclosure, the antenna receiving part can include a receiving coupling member protruded toward the outside, and the receiving coupling member can have the receiving port in which the antenna cable is received located at one side thereof and the receiving coupling member can have a core wire receiving port in which the core wire of the antenna cable is received located at the other side thereof.

According to an embodiment of the present disclosure, the body part can include a front end portion inserted into the receiving port; and a rear end portion having the outer diameter of the size different from the front end portion, and located to face the receiving coupling member located on the outer surface of the receiving port.

According to an embodiment of the present disclosure, the bush can be inserted into the receiving port together with a part of the body part, and at least part of the front end portion of the bush can form a ground by contacting a partial surface of the antenna receiving part.

According to an embodiment of the present disclosure, the bush can be formed in a cylindrical shape to surround the outer circumferential surface of the antenna cable, and the front end portion of the bush or the rear end portion of the bush can include at least one slit having one side opened.

According to an embodiment of the present disclosure, the front end portion of the bush or the rear end portion of the bush including at least one slit can fix the antenna cable to the inside of the the receiving coupling member by the pressurization of the body part.

According to an embodiment of the present disclosure, the front end portion of the bush and the rear end portion of the bush can have different slopes.

According to an embodiment of the present disclosure, the front end portion of the bush can include a contact surface protruded to have a relatively larger outer diameter than the rear end portion of the bush, and the contact surface can form a ground by contacting the outer surface of the receiving coupling member.

According to an embodiment of the present disclosure, the contact surface can include at least one protrusion part in a closed curve shape protruded toward the insertion direction of the antenna cable, and the at least one of protrusion part can contact the outer surface around the core wire receiving port located at the inside of the antenna receiving part to form a contact point surface.

According to an embodiment of the present disclosure, the antenna receiving part can have an upside opened, and a printed circuit board can be located on the lower portion of the contact member in the antenna receiving part.

According to an embodiment of the present disclosure, the inner diameter of the body part can form an inclined surface or a stepped surface in order to correspond to the outer surface of the front end portion of the bush or the rear end portion of the bush.

According to an embodiment of the present disclosure, the at least one slit of the front end portion of the bush or the rear end portion of the bush can be pressurized by the inside surface of the body part to strengthen the coupling between the antenna receiving part and the antenna cable while the size of the slit reduces.

A method for manufacturing an antenna cable connection module in accordance with various embodiments of the present disclosure can include preparing an antenna cable having an end portion partially covered; inserting a bush having an inclined surface having a slop in a longitudinal direction formed thereon and a body part having a relatively larger outer diameter than the bush into the outer circumferential surface of the antenna cable; coupling the bush to the end portion of the antenna cable; inserting the antenna cable to which the bush is coupled into an antenna receiving part prepared outside an antenna filter part; and coupling the antenna receiving part and the body part so that the body part pressurizes it to the inside of the antenna receiving part while surrounding the outer circumferential surface of the bush.

According to an embodiment of the present disclosure, the bush can be formed in a cylindrical shape to surround the outer circumferential surface of the cable, and the front end portion of the bush or the rear end portion of the bush can include at least one slit having one side opened.

According to an embodiment of the present disclosure, the coupling the bush to the end portion of the antenna cable can include strengthening the coupling between the antenna receiving part and the antenna cable while the size of the slit reduces by pressurizing the at least one slit of the front end portion of the bush or the rear end portion of the bush by the inside surface of the body part.

According to an embodiment of the present disclosure, the inserting the antenna cable to which the bush is coupled into the antenna receiving part can include forming a ground by contacting a protruded contact surface of the front end portion of the bush with the outer surface of a receiving coupling member located at one side of the antenna receiving part.

According to an embodiment of the present disclosure, in the coupling the antenna receiving part and the body part, the front end portion of the body part can be inserted into a receiving port located on the antenna receiving part, and the rear end portion of the body part having the outer diameter of the size different from the front end portion can be located to face the receiving coupling member located on the outer surface of the receiving port.

According to an embodiment of the present disclosure, the contact member located at the lower side of a receiving space of the antenna receiving part can include forming a core wire and a contact point of the antenna cable inserted into the receiving space.

Advantageous Effects

According to various embodiments of the present disclosure, it is possible to provide a simple antenna cable connection module of a ground contact type, thus minimizing the failure occurrence rate.

In addition, according to an embodiment of the present disclosure, it is possible to provide a simple antenna cable connection module so that ordinary operators can easily operate, thus reducing the labor cost and saving the time required for connecting the antenna cable.

In addition, according to an embodiment of the present disclosure, it is possible to connect the antenna cable with only minimal solder, thus providing a device that can save the parts cost consumed by the solder and reduce the weight of the product.

DESCRIPTION OF DRAWINGS

FIG. 3 is a perspective diagram illustrating an antenna cable of the antenna cable connection module and a connection component for connecting the antenna cable and a filter part in accordance with various embodiments of the present disclosure.

FIG. 4 is a cross-sectional diagram illustrating a shape coupling the antenna cable and the antenna filter part in accordance with various embodiments of the present disclosure.

FIG. 5 is a perspective diagram coupling the antenna cable and the antenna filter part in accordance with various embodiments of the present disclosure.

FIG. 6 is an exploded perspective diagram illustrating a connection procedure of the antenna cable connection module in accordance with various embodiments of the present disclosure.

FIG. 7 is a perspective diagram illustrating the antenna cable of the antenna cable connection module and the connection component for connecting the antenna cable and the antenna filter part in accordance with various embodiments of the present disclosure.

FIG. 8 is an enlarged perspective diagram illustrating a bush of the antenna cable connection module in accordance with various embodiments of the present disclosure.

FIG. 9 is a cross-sectional diagram illustrating a shape coupling the antenna cable and the antenna filter part in accordance with various embodiments of the present disclosure.

FIG. 10 is a perspective diagram coupling the antenna cable and the antenna filter part in accordance with various embodiments of the present disclosure.

FIG. 11 is a flowchart illustrating a method for manufacturing the antenna cable connection module in accordance with various embodiments of the present disclosure.

DETAILED DESCRIPTION OF MAIN ELEMENTS

Figure 1:
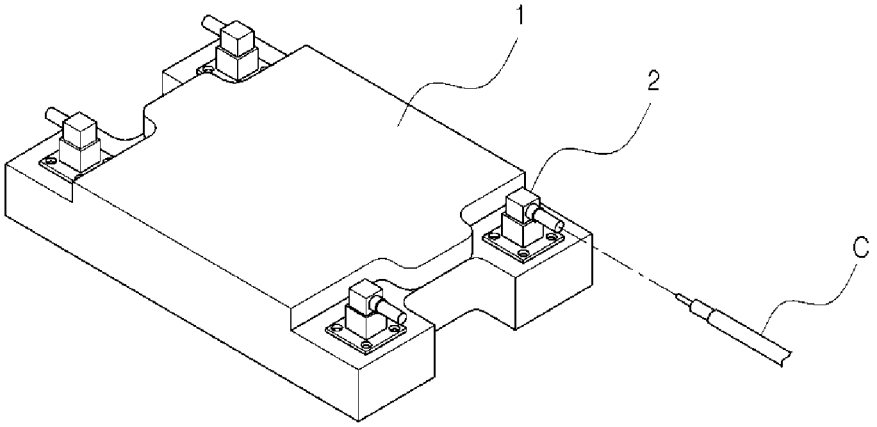
FIG. 1 is a perspective diagram illustrating a configuration of a conventional antenna cable connection module.

110, 210: body part,
111, 211: front end portion of body part
113, 213: rear end portion of body part,
130, 230: bush
131, 231: front end portion of bush,
133, 233: rear end portion of bush
135: slit,
300: antenna filter part
310: filter main body,
330: antenna receiving part
331: receiving space,
333: receiving port
335: receiving coupling member,
337: contact member

BEST MODE

Hereinafter, various embodiments of the present disclosure will be described with reference to the accompanying drawings. It should be understood, however, that it is not intended to limit the technology described in the present disclosure to the specific embodiments, but includes various modifications, equivalents, and/or alternatives of the embodiments of the present disclosure. In the description of the drawings, like reference numerals can be denoted for like elements.

The terms used in the present disclosure is used for describing specific embodiments only and is not intended to limit the scope of the other embodiments. The singular expressions can include plural expressions unless the context clearly dictates otherwise. The terms including technical and scientific terms used herein have the same meaning as commonly understood by one of ordinary skill in the art to which the present disclosure belongs. It will be further understood that terms, such as those defined in commonly used dictionaries, should be additionally interpreted as having a meaning that is consistent with their meaning in the context of the relevant art, and will not be interpreted in an idealized or overly formal sense unless expressly so defined in the application. In some cases, the terms defined in the present disclosure cannot be construed as excluding the embodiments of the present disclosure.

Hereinafter, an antenna cable connection module and a method for manufacturing the same, which connect an antenna filter and a cable in accordance with various embodiments will be described with reference to the accompanying drawings. In the present disclosure, the term operator can refer to a person installing an antenna cable connection module or a device installing an antenna cable connection module (e.g., an artificial intelligence electronic device).

Figure 2:
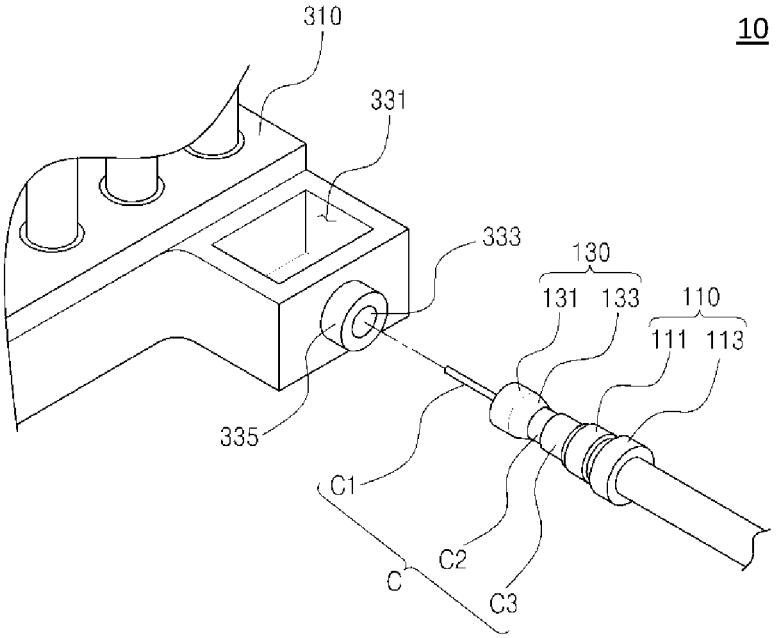
FIG. 2 is an exploded perspective diagram illustrating a configuration of an antenna cable connection module in accordance with various embodiments of the present disclosure.

FIG. 2 is an exploded perspective diagram illustrating a connection procedure of an antenna cable connection module 10 in accordance with an embodiment of the present disclosure.

As illustrated in FIG. 2, the antenna cable connection module 10 can be configured to include an antenna filter part 300 for selectively passing a frequency of a specific wavelength band, or entirely adjusting the amount of a frequency, and an antenna cable C connected to the antenna filter part 300 to deliver a signal. The antenna cable C can be configured to include a plurality of power line units and a plurality of optical units. For example, the composite antenna cable C can use an RF cable for transmitting and receiving a specific signal such as a radio signal having a high frequency, which is provided to equipment parts such as a switching station device, a base station device, or a repeater. In addition, the RF cable needs to be branched to a plurality of cables according to the use and a frequency of a signal, and a connector manufactured to be suitable for the structural characteristics of the connecting parts can be used.

According to an embodiment of the present disclosure, the antenna cable C provided to a base station equipment, for example, a Remote Radio Head (RRH) or a Remote Radio Antenna (RRA) can be connected through a cable branch device (not illustrated) in order to branch it into a plurality of branched cables.

Referring again to FIG. 2, the antenna filter part 300 can include a filter main body 310 on which a filter for passing a specific frequency band is located, and an antenna receiving part 330 for receiving the antenna cable C in order to provide a signal transmitted/received from the antenna cable C toward the filter main body 310.

According to an embodiment of the present disclosure, an antenna receiving part 330 is located to receive at least part of the external antenna cable C by forming a predetermined receiving space 331 at the outside of the filter main body 310, and can be composed of at least one.

According to an embodiment of the present disclosure, the antenna receiving part 330 can be located to have the upper surface opened at the outside of the filter main body 310. In addition, for example, the antenna receiving part 330 can include a receiving port 333 through which a core wire C1 of the antenna cable C can pass and a receiving coupling member 335 protruded toward the outside of the antenna receiving part 330 to couple the antenna cable C. In addition, the antenna receiving part 330 can include a contact member 337 located at the lower side of the internal receiving space 331 and grounded with the core wire of the antenna cable C.

According to an embodiment of the present disclosure, the receiving port 333 can be formed to open inside the coupling member 335 in order to penetrate the receiving space 331 and the outside.

According to an embodiment of the present disclosure, the antenna receiving part 330 can be installed in plural in the filter main body 310 so that a part of each antenna cable C can be received and coupled. The antenna receiving part 330 can be in the form of a housing having an upper portion opened, and can be injection molding made of any one of PAAS, Polyphenylene Sulfide (PPS), and Polyphthal Amide (PPA). In addition, the antenna receiving part 330 can be manufactured by zinc die casting or aluminum die casting, and can be manufactured by processing a metal material. In addition, the outer circumferential surface of the antenna receiving part 330 can be coated with a material resistant to high salt water. For example, the outer circumferential surface can protect the antenna receiving part from the external environment by applying or plating with a material resistant to corrosion, etc. against high salt water.

According to an embodiment of the present disclosure, the contact member 337 located in at least one line can be located on the upper surface of the antenna receiving part 330 to be grounded with the core wire C1 of the antenna cable C to form a ground surface, as viewed from the opened upper portion of the antenna receiving part 330. For example, a printed circuit board P can be located on the lower portion of the contact member 337 in the antenna receiving part 330 to form a line that is parallel to the direction of the core wire C1 of the antenna cable C drawn into a first direction (an insertion direction of the antenna cable).

According to an embodiment of the present disclosure, the upper surface of the antenna receiving part 330 is opened, such that an operator can electrically and easily connect the antenna cable C and the filter region through soldering, etc. with the core wire C1 located on one surface of the contact member 337.

Referring again to FIG. 2, the antenna cable connection module 10 in accordance with the present disclosure can include a body part 110 and a bush 130 located on the outer circumferential surface of the antenna cable C in order to firmly couple the antenna cable C and the antenna filter part 300.

Hereinafter, the body part 110 and the bush 130 will be described in detail with reference to FIGS. 3 and 4.

FIG. 3 is a perspective diagram illustrating an antenna cable C of the antenna cable connection module 10 and connection components 110, 130 for connecting the antenna cable C and the filter part 300 in accordance with an embodiment of the present disclosure.

As illustrated in FIG. 3, the antenna cable C is a coaxial cable, and has a structure for preventing electromagnetic wave interference by using a shielding shield connected to a ground. For example, the antenna cable C is provided with an internal conductor such as the core wire C1 at its center, an insulator and an external conductor C2 are located along the outer circumferential surface of the core wire C1, and the covering C3 can be located to be surrounded along the outer circumferential surface of the external conductor C2.

According to an embodiment of the present disclosure, the connection component for connecting the antenna cable C and the filter part 300 can include the body part 110 and the bush 130.

According to an embodiment of the present disclosure, the body part 110 can be formed in a cylindrical shape having a hole that the antenna cable C can be inserted and passed, and can form a front end portion 111 and a rear end portion 113 having outer diameters of different thicknesses. The front end portion 111 of the body part 110 can be an area that is substantially inserted into and coupled to the receiving port 333, and the rear end portion 113 of the body part 110 can be an area that has the outer circumferential surface having the same size as the receiving port 333 and is located so that the antenna cable C and the antenna receiving part 330 face with each other upon coupling.

According to an embodiment of the present disclosure, the front end portion 111 of the body part 110 can be inserted into the receiving port 333 of the antenna receiving part 330 and connected by the detachable coupling, or a thread is provided on the outer surface of the front end portion 111 and male and female coupling can be implemented by a thread located in the receiving port 333. However, it is only one example of the coupling methods, and the front end portion 111 of the body part 110 can have various shapes that can be coupled with the receiving port 333. In addition, the body part 110 can be manufactured by zinc die casting or aluminum die casting, and can be manufactured by processing a metal material.

According to an embodiment of the present disclosure, the front end portion 111 of the body part 110 is located to surround the outer circumferential surface of the bush 130, which will be described later, and a part of the rear end portion 113 can be located to surround the outer surface of the bush 130 or the covering C3 of the antenna cable C.

According to an embodiment of the present disclosure, the bush 130 can be formed in a cylindrical shape having a hole that the end portion of the antenna cable C can be inserted and passed, and can form a front end portion 131 and a rear end portion 133 having different slopes. For example, the front end portion 131 and the rear end portion 133 of the bush 130 are areas that are substantially inserted into the receiving port 333 to strengthen the coupling therebetween, and can be interposed between the antenna cable C and the body part 110.

According to an embodiment of the present disclosure, the front end portion 131 of the bush 130 can include at least one slit 135 located to open in a first direction (an insertion direction of the antenna cable). The slit 135 can be formed in plural at a predetermined interval in order to surround the outer surface of the external conductor C2 of the antenna cable C. In addition, for example, while the internal interval between the respective slits 135 is reduced in the pressurization process in which the body part 110 is inserted into and coupled to the receiving port 333, the coupling between the antenna cable C and the antenna receiving part 330 can be strengthened through the tension for restoring the interval to the original state.

According to an embodiment of the present disclosure, the rear end portion 133 of the bush 130 can form an inclined surface 137 having a predetermined slope unlike the front end portion 131. According to the rear end portion 133 having the inclined surface 137, the bush 130 is not pushed toward the inside of the antenna cable C (the direction in which the covering is located) in the pressurization process that occurs when coupling the antenna cable C and the antenna receiving part 330, and the pressurization can be performed in a state of being fixed to the outer surface of the external conductor C2. In addition, the bush 130 can be manufactured by zinc die casting or aluminum die casting, and can be manufactured by processing a metal material. Herein, the inner diameter of the body part 110 can form an inclined surface or a stepped surface in order to correspond to the outer surface of the front end portion 131 of the bush 130 or the rear end portion 133 of the bush 130.

According to an embodiment of the present disclosure, a groove (not illustrated) can be located at the outside of the front end portion 111 of the body part 110, and a sealing member can be located in the groove. Accordingly, the front end portion 111 of the body part 110 can be inserted into and coupled to the receiving port 333 of the antenna receiving part 330 and can provide a waterproof function for preventing external fluid from permeating into the antenna cable or the antenna receiving part.

FIG. 4 is a cross-sectional diagram illustrating a shape coupling the antenna cable C and the antenna filter part 300 in accordance with various embodiments of the present disclosure.

As illustrated in FIG. 4, the antenna cable C can be inserted into the receiving port 333, and the bush 130, the body part 110, and the receiving coupling member 335 can be located outwards around the antenna cable C.

According to an embodiment of the present disclosure, the inside of the receiving coupling member 335 can include a core wire receiving port 339 smaller than the receiving port 333 therein so that only the core wire C1 of the antenna cable C can pass through the inside of the antenna receiving part 330. Accordingly, only the core wire C1 of the antenna cable C can be located in the antenna receiving part 330 substantially.

According to an embodiment of the present disclosure, the bush 130 can be located on the outer surface of the external conductor C2 of the antenna cable C. As described above, the front end portion 131 of the bush 130 can include at least one slit 135 to strengthen the coupling between the end portion of the external conductor C2 and the receiving coupling member 335, and the rear end portion 133 of the bush 130 can have the inclined surface 137 to strengthen the coupling therebetween, thus preventing the bush 130 from being pushed from the end portion of the external conductor C2 toward the covering.

According to an embodiment of the present disclosure, the front end portion 131 of the bush 130 can form a ground by directly contacting a partial surface of the receiving coupling member 335 around the core wire receiving port 339. The ground formed by press-fitting of the body part 110 pushing the bush 130 can closely located the front surface of the bush 130 on the antenna receiving part 330 even without using a soldering method, thus strengthening the coupling of the electrical connection.

According to an embodiment of the present disclosure, the body part 110 can be located on the outer surface of the bush 130 or the external conductor C2 of the antenna cable C. The front end portion 111 of the body part 110 is inserted up to the inside end portion of the receiving port 333 to pressurize the bush 130, thus strengthening the coupling between the antenna cable C and the antenna receiving part 330, and the rear end portion 113 of the body part 110 can be located at the outside of the antenna receiving part 330 to face the receiving port 333 and can be located to surround the covering of the antenna cable C. The body part 110 can be implemented in a shape corresponding to the external conductor C2 (or the outer circumferential surface of the bush 130) and the covering C3 having different outer diameters of the antenna cable C, respectively, thus fixing the entire antenna cable C and helping tighten coupling therebetween.

FIG. 5 is a perspective diagram coupling an antenna cable C and an antenna filter part 300 in accordance with various embodiments of the present disclosure.

As illustrated in FIG. 5, when the antenna cable C is inserted into and coupled to the antenna receiving part 330, the core wire C1 of the antenna cable C can be located in the receiving space 331, and can form an electrical contact point by contacting the contact member 337 formed on the upper surface of the receiving space 331. In addition, the bush 130 can form a good ground through the strengthened contact with the antenna receiving part 330 by the pressurization of the body part 110.

Accordance to an embodiment of the present disclosure, the antenna cable connection module 10 illustrates only one connection between the antenna cable C and the antenna receiving part 330, but it is natural that it is possible to transmit and receive signals of various bandwidths to the filter by forming a plurality of antenna receiving parts 330 on the outer surface of the filter main body 310 to connect a plurality of antenna cables C corresponding thereto.

Unlike the conventional technology, the antenna cable connection module 10 in accordance with the present disclosure has implemented by providing the antenna receiving part 330 that can be connected to the antenna filter through a simple connection operation of the antenna cable C, and including coupling components that can strengthen the coupling with the antenna receiving part 330 on the outer surface of the antenna cable C. As a result, it is possible for ordinary operators to easily connect the cable to the antenna, thus improving the productivity, and to remarkably reduce the use of the soldering, thus saving the product cost and reducing a failure occurrence rate.

FIG. 6 is an exploded perspective diagram illustrating a connection procedure of the antenna cable connection module 10 in accordance with another embodiment of the present disclosure.

As illustrated in FIG. 6, the antenna cable connection module 10 can be configured to include the antenna filter part 300 for selectively passing through a frequency of a specific wavelength band or entirely adjusting the amount of a frequency, and the antenna cable C connected to the antenna filter part 300 to deliver a signal. The antenna cable C can be configured to include a plurality of power line units and a plurality of optical units.

According to an embodiment of the present disclosure, the antenna filter part 300 can include the filter main body 310 in which the filter for passing through a specific frequency band is located, and the antenna receiving part 330 for receiving the antenna cable C in order to provide a signal transmitted/received from the antenna cable C toward the filter main body 310.

According to an embodiment of the present disclosure, the antenna receiving part 330 is located to receive at least part of the external antenna cable C by forming a predetermined receiving space 331 at the outside of the filter main body 310, and can be composed of at least one.

According to an embodiment of the present disclosure, the antenna receiving part 330 can be located to have an upper surface opened at the outside of the filter main body 310. In addition, for example, the antenna receiving part 330 can include the receiving port 333 through which the core wire C1 of the antenna cable C can pass and the receiving coupling member 335 that can be protruded toward the outside of the antenna receiving part 330 to couple the antenna cable C. In addition, the antenna receiving part 330 can include the contact member 337 that is located at the lower side of the receiving space 331 therein, and is grounded with the core wire of the antenna cable C.

Hereinafter, the antenna receiving part 330 of the antenna cable C is the same as that of the above-described embodiment, such that the description of the contents overlapping with those of the above-described embodiment will be omitted in the present embodiment.

The antenna cable connection module 10 in accordance with the present disclosure can include a body part 210 and a bush 230 located on the outer circumferential surface of the antenna cable C in order to firmly couple the antenna cable C and the antenna filter part 300.

Hereinafter, the body part 210 and the bush 230 will be described in detail with reference to FIGS. 7 to 9.

FIG. 7 is a perspective diagram illustrating the antenna cable C of the antenna cable connection module 10 and the connection components 210, 230 for connecting the antenna cable C and the antenna filter part 300 in accordance with various embodiments of the present disclosure. FIG. 8 is an enlarged perspective diagram of the bush 230 of the antenna cable connection module 10 in accordance with various embodiments of the present disclosure.

As illustrated in FIGS. 7 and 8, the antenna cable C is a coaxial cable, and has a structure for preventing electromagnetic wave interference by using a shielding shield connected to a ground. For example, the antenna cable C can have an internal conductor such as the core wire C1 at its center, an insulator and the external conductor C2 can be located along the outer circumferential surface of the core wire C1, and the covering C3 can be located to surround along the outer circumferential surface of the external conductor C2.

According to an embodiment of the present disclosure, the connection component for connecting the antenna cable C and the filter part 300 can include the body part 210 and the bush 230.

According to an embodiment of the present disclosure, the body part 210 can be formed in a cylindrical shape having a hole that the antenna cable C can be inserted and passed, and can form the front end portion 211 and the rear end portion 213 having the outer diameters of different thicknesses. The front end portion 211 of the body part 210 can be an area that is substantially inserted into and coupled to the receiving port 333, and the rear end portion 213 of the body part 210 can be an area that has the outer circumferential surface having the same size as the receiving port 333 and is located to face each other when coupling the antenna cable C and the antenna receiving part 330.

According to an embodiment of the present disclosure, the front end portion 211 of the body part 210 can be inserted into the receiving port 333 of the antenna receiving part 330 and connected by the detachable coupling, or a thread is provided on the outer surface of the front end portion 211, and male and female coupling can be implemented by a thread located in the receiving port 333. However, it is only one example of the coupling methods, and the front end portion 211 of the body part 210 can have various shapes that can be coupled with the receiving port 333. In addition, the body part 210 can be manufactured by zinc die casting or aluminum die casting, and can be manufactured by processing a metal material.

According to an embodiment of the present disclosure, the front end portion 211 of the body part 210 is located to surround the outer circumferential surface of the bush 230, which will be described later, and a part of the rear end portion 213 can be located to surround the outer surface of the bush 230 or the covering C3 of the antenna cable C.

According to an embodiment of the present disclosure, the bush 230 can be formed in a cylindrical shape having a hole that the end portion of the antenna cable C can be inserted and passed, and can form the front end portion 231 and the rear end portion 233 having different slopes. For example, the front end portion 231 and the rear end portion 233 of the bush 230 are areas that are substantially inserted into the receiving port 333 to strengthen the coupling therebetween, and can be interposed between the antenna cable C and the body part 210.

According to an embodiment of the present disclosure, the front end portion 231 of the bush 230 can be formed to have a closed curve having a relatively larger outer diameter than the rear end portion 233. For example, the front end portion 231 has a ring-shaped structure, and when the front end portion 231 of the bush 230 is coupled to the inside of the antenna receiving part 330, a contact surface 238 that can form a ground can be located on the front surface portion thereof (the area contacting the receiving coupling member).

The bush 230 in accordance with the present disclosure has a ring-shaped contact surface 238 having a relatively wider area unlike the bush 130 of the above-described embodiment (FIG. 1) to further strengthen the ground contact than in the previous embodiment, thus implementing high electrical connection performance in the present disclosure.

According to an embodiment of the present disclosure, a protrusion part 239 protruded from the contact surface 238 in a first direction (an insertion direction of the antenna cable) can be formed and further located on the contact surface 238 of the front end portion 231 of the bush 230.

Specifically, the contact surface 238 includes at least one protrusion part 239 in a closed curve shape protruded toward the first direction (the insertion direction of the antenna cable), and the protrusion part 239 forms a contact point surface by contacting the outer surface around the core wire receiving port 339 located in the antenna receiving part 330. The protrusion part 239 illustrated in FIG. 8 can be formed in a ring shape, and can strengthen a force that closely contacts the outer surface of the antenna receiving part 330.

The rear end portion 233 of the bush 230 can include at least one slit 235 located to open in a direction opposite to the first direction (the insertion direction of the antenna cable). The slit 235 can be formed in plural at a predetermined interval in order to surround the outer surface of the external conductor C2 of the antenna cable C. In addition, for example, while the at least internal interval between the respective slits 235 reduces in the pressurization process in which the body part 210 is inserted into and coupled to the receiving port 333, the coupling between the antenna cable C and the antenna receiving part 330 can be strengthened through the tension for restoring the interval to the original state.

According to an embodiment of the present disclosure, the rear end portion 233 of the bush 230 can form the inclined surface 237 having a predetermined slope unlike the front end portion 231. According to the rear end portion 233 including the inclined surface 237, the bush 230 is not pushed into the antenna cable C (the direction in which the covering is located) in the pressurization process occurred when coupling the antenna cable C and the antenna receiving part 330, and the pressurization can be performed in a state of being fixed to the outer surface of the external conductor C2. In addition, the bush 230 can be manufactured by zinc die casting or aluminum die casting, and can be manufactured by processing a metal material.

According to an embodiment of the present disclosure, a groove (not illustrated) can be located at the outside of the front end portion 211 of the body part 210, and a sealing member can be located in the groove. Accordingly, the front end portion 211 of the body part 210 can be inserted into and coupled to the receiving port 333 of the antenna receiving part 330, and can provide a waterproof function for preventing external fluid from permeating into the antenna cable or the antenna receiving part.

FIG. 9 is a cross-sectional diagram illustrating a shape coupling an antenna cable C and an antenna filter part 300 in accordance with various embodiments of the present disclosure.

As illustrated in FIG. 9, the antenna cable C is inserted into the receiving port 333, and the bush 230, the body part 210, and the receiving coupling member 335 can be located toward the outside around the antenna cable C.

According to an embodiment of the present disclosure, the inside of the receiving coupling member 335 can include the core wire receiving port 339 smaller than the receiving port therein so that only the core wire C1 of the antenna cable C can pass through the inside of the antenna receiving part 330. Accordingly, only the core wire C1 of the antenna cable C can be located in the antenna receiving part 330 substantially.

According to an embodiment of the present disclosure, the bush 230 can be located on the outer surface of the external conductor C2 of the antenna cable C. As described above, the rear end portion 233 of the bush 230 can include at least one slit 235, thus strengthening the coupling between the end portion of the external conductor C2 and the receiving coupling member 335, and the rear end portion 233 of the bush 230 can have the inclined surface 237 to strengthen the coupling therebetween, thus preventing the bush 230 from being pushed from the end portion of the external conductor C2.

According to an embodiment of the present disclosure, the front end portion 231 of the bush 230 can form a ground by directly contacting a partial surface of the receiving coupling member 335 around the core wire receiving port 339. The ring-shaped contact surface 238 protruded toward the first direction (the insertion direction of the antenna cable) can be located on the front surface of the bush 230 directly contacting the partial surface of the receiving coupling member 335. The contact surface 238 can be implemented to be spread relatively wider than the other portions of the bush 230, such that an area substantially contacting the partial surface of the receiving coupling member 335 can be further expanded than the previous embodiment (FIG. 1). It is possible to provide the contact surface 238 composed of the relatively further expanded area, thus further strengthening the ground contact than the previous embodiment and implementing high electrical connection performance in the present disclosure.

According to an embodiment of the present disclosure, the protrusion part 239 protruded from the contact surface 238 in the first direction can be formed and further located on the front surface of the contact surface 238 of the front end portion 231 of the bush 230. The protrusion part 239 can be formed in a ring shape, and can strengthen a force that closely contacts the outer surface of the antenna receiving part 330.

According to the additional configurations of the contact surface 238 and the protrusion part 239 as described above, the ground formed by the press-fitting of the body part 210 pushing the bush 230 closely locates the front surface of the bush 230 on the antenna receiving part 330 even without using a soldering method, thus strengthening the coupling of the electrical connection.

According to an embodiment of the present disclosure, the body part 210 can be located on the outer surface of the bush 230 or the external conductor C2 of the antenna cable C. The front end portion 211 of the body part 210 is inserted up to the inside end portion of the receiving port 333 to pressurize the bush 230, thus strengthening the coupling between the antenna cable C and the antenna receiving part 330, and the rear end portion 213 of the body part 210 can be located on the outside of the antenna receiving part 330 to face the receiving port 333, and can be located to surround the covering of the antenna cable C. The body part 210 can be formed in a shape corresponding to the external conductor C2 (or the outer circumferential surface of the bush 130) and the covering C3 having different outer diameters of the antenna cable C, respectively, thus fixing the entire antenna cable C and helping tighten coupling therebetween.

FIG. 10 is a perspective diagram coupling an antenna cable C and an antenna filter part 300 in accordance with various embodiments of the present disclosure.

As illustrated in FIG. 10, when the antenna cable C is inserted into and coupled to the antenna receiving part 330, the core wire C1 of the antenna cable C can be located in the receiving space 331, and can contact the contact member 337 located on the upper surface of the receiving space 331 to form the electrical contact point. In addition, the bush can form a good ground through the strengthened contact with the antenna receiving part 330 by the pressurization of the body part 110.

Unlike the conventional technology, the antenna cable connection module 10 in accordance with the present disclosure has implemented by providing the antenna receiving part 330 that can be connected to the antenna filter through a simple connection operation of the antenna cable C, and including the coupling components that can strengthen the coupling with the antenna receiving part 330 on the outer surface of the antenna cable C. As a result, it is possible for ordinary operators to easily connect the cable to the antenna, thus improving productivity, and to remarkably reduce the use of a soldering, thus saving the product cost and reducing the failure occurrence rate.

Hereinafter, a method for manufacturing an antenna cable connection module in accordance with various embodiments will be described.

FIG. 11 is a flowchart illustrating a method for manufacturing an antenna cable connection module 10 in accordance with various embodiments of the present disclosure.

Hereinafter, the antenna cable connection module 10 used in the manufacturing method will be described as an example to which the antenna cable connection module in FIG. 2 is applied. However, it is not limited thereto, and the antenna cable connection module in accordance with an embodiment in FIG. 6 can be also applied to the present manufacturing method.

As illustrated in FIG. 11, according to a Process 10, the method for manufacturing the antenna cable connection module 10 can firstly perform supplying the antenna cable C to be coupled to the antenna filter part 300 from the outside.

However, an operator can partially cover the end portion of the antenna cable C in advance to prepare the antenna cable C to be connected to the antenna filter part 300. For example, the antenna cable C can be formed so that an internal conductor such as the core wire C1 is exposed to the outside at its center, and the antenna cable C can be prepared in advance by forming so that parts of the insulator and the external conductor are exposed to the outside along the outer circumferential surface of the core wire C1.

Thereafter, according to a Process 30, the body part 110 and the bush 130 can be fitted and located on the outer circumferential surface of the partially covered antenna cable C (see FIG. 2). In this time, firstly fitting and locating the body part 110 having relatively large inner diameter and outer diameter into the antenna cable C can be performed, and then fitting and locating the bush 130 into the end portion area of the antenna cable C can be performed.

According to an embodiment of the present disclosure, the body part 110 can be formed in a cylindrical shape having a hole that the antenna cable C can be inserted and passed, and can form the front end portion 111 and the rear end portion 113 having outer diameters of different thicknesses. The front end portion 111 of the body part 110 can be an area that is substantially inserted into and coupled to the receiving port 333, and the rear end portion 113 of the body part 110 can be an area that has the outer circumferential surface having the same size as the receiving port 333 and is located to face each other when the antenna cable C and the antenna receiving part 330 are coupled.

In addition, according to an embodiment of the present disclosure, the bush 130 can be formed in a cylindrical shape having a hole that the end portion of the antenna cable C can be inserted and passed, and can have the front end portion 131 and the rear end portion 133 having different slopes. For example, the front end portion 131 and the rear end portion 133 of the bush 130 are areas that can be substantially inserted into the receiving port 333 to strengthen the coupling therebetween, and can be interposed between the antenna cable C and the body part 110.

Thereafter, according to Processes 50, 70, coupling the bush 130 to the end portion of the antenna cable C and inserting the antenna cable C to which the bush 130 is coupled into the antenna receiving part 330 prepared outside the antenna filter part 300 can be performed.

An operator can perform fitting and coupling the bush 130 from an area in which the core wire C1 of the antenna cable C begins to an area on which the external conductor C2 is located. The bush 130 fitted into the outer circumferential surface of the external conductor C2 can have the front end portion 131 located on the area in which the core wire C1 begins, and can have the rear end portion 133 located toward the covering C3.

According to an embodiment of the present disclosure, the front end portion 131 of the bush 130 can include at least one slit 135 located to open in a first direction (an insertion direction of the antenna cable). The slit 135 can be formed in plural at a predetermined interval in order to surround the outer surface of the external conductor C2 of the antenna cable C. Accordingly, in the antenna cable C into which the bush 131 is fitted and coupled, thereafter, while the internal interval of each slit 135 reduces in the pressurization process in which the body part 110 is inserted into and coupled to the receiving port 333, the coupling between the antenna cable C and the antenna receiving part 330 can be strengthened through the tension for restoring the interval to the original state.

According to an embodiment of the present disclosure, the inner diameter of the bush 130 reduces from the front end toward the rear end along the inclined surface of the rear end portion 133 of the bush 130, and when the bush 130 is coupled to the antenna receiving part 330, it is not pushed to the outside, thus keeping the strengthened coupling therebetween.

In addition, the front end portion 131 of the bush 130 can be formed to have a closed curve having a relatively larger outer diameter than the rear end portion 133. For example, the front end portion 131 has a ring-shaped structure, and when the front end portion 131 of the bush 130 is coupled to the inside of the antenna receiving part 330, the contact surface that can form a ground can be located on the front surface portion thereof. The bush 130 in accordance with the present disclosure can have the contact surface having a wider area than the conventional disclosure, thus strengthening the ground contact and implementing high electrical connection performance in the present disclosure.

After the bush 130 and the antenna cable C are coupled to each other, according to a Process 90, an operator can perform coupling the antenna receiving part and the body part by pressurizing it toward the inside of the receiving port 333 while surrounding the outer circumferential surface of the bush 130 by the body part 110.

According to an embodiment of the present disclosure, the front end portion 111 of the body part 110 can be inserted into the receiving port 333 of the antenna receiving part 330 and connected by the detachable coupling, or a thread can be provided on the outer surface of the front end portion 111, and male and female coupling can be performed by a thread located in the receiving port 333. However, it is only one example of the coupling methods, and the front end portion 111 of the body part 110 can have various shapes that can be coupled to the receiving port 333.

The front end portion 111 of the body part 110 is located to surround the outer circumferential surface of the bush 130, which will be described later, and a part of the rear end portion 113 can be located to surround the outer surfaces of the bush 130 or the covering C3 of the antenna cable C.

According to the Process 90, when the antenna cable C is inserted into and coupled to the antenna receiving part 330, the core wire C1 of the antenna cable C is located in the receiving space 331 of the antenna receiving part 330, and the electrical contact point can be formed by contacting the contact member 337 located on the receiving space 331.

According to an embodiment of the present disclosure, the upper surface of the antenna receiving part 330 is opened, such that an operator can electrically and easily connect the antenna cable C and the filter region through soldering, etc. with the core wire C1 located on one surface of the contact member 337.

According to an embodiment of the present disclosure, the method for manufacturing the antenna cable connection module 10 can provide a simple antenna cable connection module so that an operator can easily operate, thus implementing a device that can reduce the labor cost and save the time.

In addition, it is possible to connect the antenna cable with only minimal solder, thus saving the parts cost and reducing the weight of the product.

The antenna cable connection module of various embodiments of the present disclosure as described above is not limited by the above-described embodiments and drawings, and it will be apparent to those skilled in the art to which the present disclosure pertains that various substitutions, modifications, and changes can be made within the technical scope of the disclosure.

INDUSTRIAL APPLICABILITY

According to the present disclosure, it is possible to manufacture an antenna cable connection module, which can minimize the failure occurrence rate and connect an antenna cable with only minimal solder, thus saving the parts cost consumed by the solder and reducing the weight of the product.

The invention claimed is:

1. An antenna cable connection module, comprising:

an antenna cable configured to form a contact point to be connected to an antenna filter;

a body surrounding an outer circumferential surface of the antenna cable, and inserted into a receiving port of the antenna filter together with an end portion of the antenna cable to be coupled to the antenna filter; and a bush interposed between the antenna cable and the body, and having an inclined surface with a slope in a longitudinal direction formed thereon to strengthen the coupling between the antenna filter and the antenna cable, wherein the body comprises a front end portion configured to be inserted into the receiving port of the antenna filter, wherein the bush is configured to be inserted into the receiving port together with a part of the body, wherein the antenna filter further comprises a receiving coupling member protruded toward the outside of the antenna filter, and wherein at least a part of a front end portion of the bush is grounded by contacting a surface of the receiving coupling member.

2. The antenna cable connection module of claim 1, wherein the front end portion of the bush or the rear end portion of the bush comprising at least one slit fixes the antenna cable to the inside of the receiving coupling member by the pressurization of the body.

3. The antenna cable connection module of claim 1, wherein the antenna filter comprises an antenna receiving part for receiving a core wire of the antenna cable, and the antenna receiving part comprises a contact member that is located at a lower side of a receiving space of the antenna receiving part, and is configured to form a contact point with the core wire of the antenna cable passing through the receiving port.

4. The antenna cable connection module of claim 3, wherein the antenna receiving part has an upside opened, and a printed circuit board is located on the lower portion of the contact member in the antenna receiving part.

5. The antenna cable connection module of claim 3, wherein the receiving coupling member has the receiving port through which the antenna cable is received at one side of the receiving coupling member and the receiving coupling member has a core wire receiving port through which the core wire of the antenna cable is received at another side of the receiving coupling member.

6. The antenna cable connection module of claim 5, wherein the body further comprises a rear end portion having an outer diameter of the size different from the front end portion, and located to face the receiving coupling member located on an outer surface of the receiving port.

7. The antenna cable connection module of claim 1, wherein the bush is formed in a cylindrical shape to surround the outer circumferential surface of the antenna cable, and wherein the front end portion of the bush or the rear end portion of the bush comprises at least one slit having one side opened.

8. The antenna cable connection module of claim 7, wherein the front end portion of the bush and the rear end portion of the bush have different slopes.

9. The antenna cable connection module of claim 7, wherein an inner diameter of the body forms an inclined surface or a stepped surface in order to correspond to the outer surface of the front end portion of the bush or the rear end portion of the bush.

10. The antenna cable connection module of claim 7, wherein the at least one slit of the front end portion of the bush or the rear end portion of the bush is pressurized by the inside surface of the body to strengthen the coupling between the antenna receiving part and the antenna cable while the size of the slit reduces.

11. The antenna cable connection module of claim 7, wherein the front end portion of the bush comprises a contact surface protruded to have a relatively larger outer diameter than the rear end portion of the bush, and the contact surface is configured to be grounded by contacting the outer surface of the receiving coupling member.

12. The antenna cable connection module of claim 11, wherein the contact surface comprises at least one protrusion part in a closed curve shape protruded toward the insertion direction of the antenna cable, and an at least one of protrusion part forms a contact point surface by contacting the outer surface around the core wire receiving port located in the antenna receiving part.

13. A method of coupling an antenna cable connection module with an antenna filter having a receiving port, comprising:

preparing an antenna cable having an end portion partially covered;

inserting a bush having an inclined surface having a slop in a longitudinal direction formed thereon and a body having a relatively larger outer diameter than the bush into an outer circumferential surface of the antenna cable, wherein the body comprises a front end portion and wherein the antenna filter further comprises a receiving coupling member protruded toward the outside of the antenna filter;

inserting the front end portion of the body into the receiving port; coupling the bush to the end portion of the antenna cable;

inserting the antenna cable to which the bush is coupled into an antenna receiving part prepared at the outside of the antenna filter;

coupling the antenna receiving part and the body so that the body pressurizes it into the antenna receiving part while surrounding the outer circumferential surface of the bush; and grounding at least a part of a front end portion of the bush by contacting a surface of the receiving coupling member.

* * * * *